US008789784B2

(12) United States Patent
Ange, III

(10) Patent No.: US 8,789,784 B2
(45) Date of Patent: Jul. 29, 2014

(54) MOBILE SELF-CONTAINED LOADING AND CRUSHING APPARATUS

(75) Inventor: Elton Russell Ange, III, Cary, NC (US)

(73) Assignee: Ange Construction Co., Cary, NC (US)

( * ) Notice: Subject to any disclaimer, the term of this patent is extended or adjusted under 35 U.S.C. 154(b) by 368 days.

(21) Appl. No.: 13/108,971

(22) Filed: May 16, 2011

(65) Prior Publication Data

US 2011/0278384 A1 Nov. 17, 2011

Related U.S. Application Data

(60) Provisional application No. 61/334,907, filed on May 14, 2010.

(51) Int. Cl.
*B02C 19/00* (2006.01)
*B02C 21/02* (2006.01)
*B02C 23/02* (2006.01)

(52) U.S. Cl.
CPC ..... *B02C 23/02* (2013.01); *B02C 21/026* (2013.01)
USPC ..... 241/101.74; 241/101.76

(58) Field of Classification Search
USPC ..... 241/101.74, 101.741, 101.75, 101.76, 241/81, 69.1, 79.1, 266
See application file for complete search history.

(56) References Cited

U.S. PATENT DOCUMENTS 3,493,108 A * 2/1970 Martinez ..... 209/3
3,647,150 A 3/1972 Stephanek
4,062,498 A * 12/1977 Szepaniak ..... 241/101.76
4,168,034 A 9/1979 Leger
4,254,874 A * 3/1981 Arnoldsson et al. ..... 209/3
4,383,651 A 5/1983 Couperus
4,491,279 A 1/1985 Long et al.
4,585,179 A 4/1986 Tsuji et al.
4,598,875 A 7/1986 Bronson et al.
4,655,402 A 4/1987 Desourdy
4,676,688 A 6/1987 Caradot
4,903,903 A 2/1990 Benen
4,911,215 A * 3/1990 Phipps ..... 144/337
4,976,469 A * 12/1990 Paliard et al. ..... 241/30
5,161,744 A 11/1992 Schoop et al.
5,178,484 A 1/1993 Strunk
5,188,298 A * 2/1993 Gerber ..... 241/5
5,332,164 A 7/1994 Page
5,333,798 A * 8/1994 Paliard et al. ..... 241/24.1
5,402,898 A 4/1995 Lute
5,445,330 A 8/1995 Shokry Rashwan et al.
5,460,332 A 10/1995 Frick
5,476,227 A 12/1995 Tamura et al.

(Continued)

*Primary Examiner* — Faye Francis
(74) *Attorney, Agent, or Firm* — Hultquist, PLLC; Steven J. Hultquist; Mary B. Grant

(57) ABSTRACT

A mobile self-contained loading and crushing apparatus is described for processing concrete, rock, masonry waste and the like, which includes a crusher unit and a loading device affixed to a mobile carrier. The crusher unit has an inlet and an outlet. The loading device is capable of loading feed material into the inlet of the crusher unit. The crushing unit is capable of producing an output of crushed material, e.g., uniform crushed granular material with a diameter as small as one inch. The mobile self-contained crushing apparatus is useful for on-site or near-site recycling of concrete, rock, masonry waste and the like resulting from construction/demolition activities, and converts the solid crushable waste material into crushed product material that can be employed as a gravel base for streets and foundation structures, or as a recycled component for concrete.

20 Claims, 9 Drawing Sheets

(56) References Cited

U.S. PATENT DOCUMENTS

| | | | | |
|---|---|---|---|---|
| 5,480,041 | A | 1/1996 | Turner | |
| 5,490,755 | A | 2/1996 | Billotte | |
| 5,553,792 | A * | 9/1996 | Romer et al. | 241/29 |
| 5,647,545 | A | 7/1997 | Conner | |
| 5,655,719 | A | 8/1997 | Getz | |
| 5,738,289 | A | 4/1998 | Tagawa | |
| 5,762,446 | A * | 6/1998 | Manatt et al. | 404/75 |
| 5,788,168 | A | 8/1998 | Gilbert et al. | |
| 5,875,980 | A | 3/1999 | Schmid | |
| 5,887,810 | A | 3/1999 | Maruyama | |
| 5,938,373 | A * | 8/1999 | Scudder | 405/179 |
| 6,027,054 | A * | 2/2000 | Kaye et al. | 241/33 |
| 6,354,524 | B1 | 3/2002 | Nakayama et al. | |
| 6,398,140 | B1 * | 6/2002 | Stieh et al. | 241/101.741 |
| 6,412,530 | B1 * | 7/2002 | Mangold | 144/364 |
| 6,540,166 | B2 | 4/2003 | Frick | |
| 6,626,608 | B2 | 9/2003 | Olynyk | |
| 6,668,712 | B1 | 12/2003 | Gervais | |
| 6,752,339 | B2 | 6/2004 | Moriya et al. | |
| 6,871,807 | B2 | 3/2005 | Rossi | |
| 6,877,610 | B2 * | 4/2005 | Boast | 209/405 |
| 6,915,972 | B2 | 7/2005 | Rossi | |
| 7,004,411 | B2 * | 2/2006 | Nuora et al. | 241/101.74 |
| 7,182,284 | B2 * | 2/2007 | Jabs et al. | 241/101.74 |
| 7,588,204 | B2 | 9/2009 | Douglas et al. | |
| 7,618,002 | B2 * | 11/2009 | Sato | 241/79.1 |
| 7,942,355 | B2 * | 5/2011 | Yamazaki et al. | 241/101.2 |
| 8,020,800 | B2 * | 9/2011 | Potts | 241/101.74 |
| 8,118,246 | B2 * | 2/2012 | Yamaguchi et al. | 241/36 |
| 2003/0071151 | A1 * | 4/2003 | Gross et al. | 241/93 |
| 2003/0141394 | A1 * | 7/2003 | Ueda et al. | 241/73 |
| 2006/0202073 | A1 * | 9/2006 | Heeszel et al. | 241/101.74 |
| 2008/0041984 | A1 | 2/2008 | Sauser et al. | |
| 2008/0044264 | A1 | 2/2008 | Sauser | |
| 2009/0114750 | A1 * | 5/2009 | Yamazaki et al. | 241/34 |

* cited by examiner

MOBILE SELF-CONTAINED LOADING AND CRUSHING APPARATUS

The benefit of priority under 35 USC 119 of U.S. Provisional Patent Application No. 61/334,907 filed May 14, 2011 in the name of Elton Russell Ange, III for "MOBILE SELF-CONTAINED LOADING AND CRUSHING APPARATUS" is hereby claimed. The disclosure of U.S. Provisional Patent Application No. 61/334,907 is hereby incorporated herein by reference in its entirety, for all purposes.

FIELD

The present invention relates to mobile crushers and loading devices that are useful for processing raw materials such as concrete, rock and the like, and that are capable of being transported on conventional public roadways, including secondary and tertiary roads. More specifically, the invention relates to a self-contained loading and crushing system that incorporates a crusher unit and loading device in a unitary mobile apparatus (truck, trailer, vehicular assembly, or the like) for use and transport on such roadways. Additionally, the invention relates to a method of on-site or near-site recycling of rock, concrete, construction debris, or similar type waste materials by use of a self-contained loader and crusher apparatus. By combining a crusher unit and a loading device on a same mobile apparatus, the loader and crusher apparatus is completely self-contained and may be configured in specific embodiments for operation by a single individual, thereby avoiding the necessity of additional vehicles, persons and devices for transport, loading, processing and use of the feed waste material.

BACKGROUND

Crusher units are used within the construction industry to treat construction debris, e.g., waste concrete resulting from construction of streets, curbs and driveways, breaking up of concrete and aggregate for re-paving of highways, and stone, rock, gravel and concrete waste material that is generated when buildings are demolished or razed. Typically, these materials are disposed of in landfills. The volume of such concrete waste in landfills is continually rising, and this has resulted in land fill surcharges die to the difficulties of accommodating concrete waste in landfills, and even prohibitions in some landfills against acceptance of such waste. Reclaiming and recycling building materials, reusing construction debris, concrete, and masonry waste to produce reusable material is both beneficial and desirable, for economic and ecological reasons. Crusher installations can produce reusable materials by reducing large pieces of construction or demolition debris into useful products such as aggregates, fillers and additives for concrete, road surfaces, or the like.

The crushing of the large chunks of concrete waste or other crushable solid debris generated during construction or demolition activities is typically transported to and processed by large crushing plant installations. The crushing plants consist of multiple very large and heavy crushing machines that include screening devices for separating particulates or smaller sized material from the waste.

These involve substantial transportation charges, both for the initial waste concrete and transport of the resulting crushed material to a location as well as load limitations on roadways.

Accordingly, there is a compelling need for apparatus and methods for processing of concrete and other solid crushable waste for recycling and reclamation usage, to avoid the substantial and increasing volumes of such materials that are being disposed of in landfills.

SUMMARY

The present invention relates to apparatus and methodology for processing of crushable solid waste materials such as waste concrete and other construction/demolition debris, to form a crushed material product.

The invention relates in one aspect to a mobile loading and crushing apparatus, comprising:

a mobile carrier;

a crusher unit having an inlet and an outlet, wherein the crusher unit is affixed to the mobile carrier; and a loading device affixed to the mobile carrier, wherein the loading device is capable of loading the inlet of the crusher unit with feed material for crushing by the crusher unit.

Another aspect of the invention relates to a method of processing a crushable solid feed material, comprising:

loading said feed material into an inlet of a crusher unit with a loading device, wherein the loading device and the crusher unit are affixed to a mobile carrier;

reducing the feed material in the crusher unit to crushed material comprising pieces having size within a range from about 1 inch in diameter to about 5 inches in diameter; and providing an output stream of the crushed material.

A further aspect of the invention relates to a mobile system for processing solid crushable feed material, comprising:

a mobile carrier;

a crusher unit having an inlet and an outlet, wherein the crusher unit is affixed to the mobile carrier;

a loading device affixed to the mobile carrier, wherein the loading device is capable of loading the inlet of the crusher unit with feed material for crushing by the crusher unit; and an operating station for operating the crusher unit and the loading device.

Other aspects, features and embodiments of the invention will be more fully apparent from the ensuing disclosure and appended claims.

DETAILED DESCRIPTION

Figure 1:
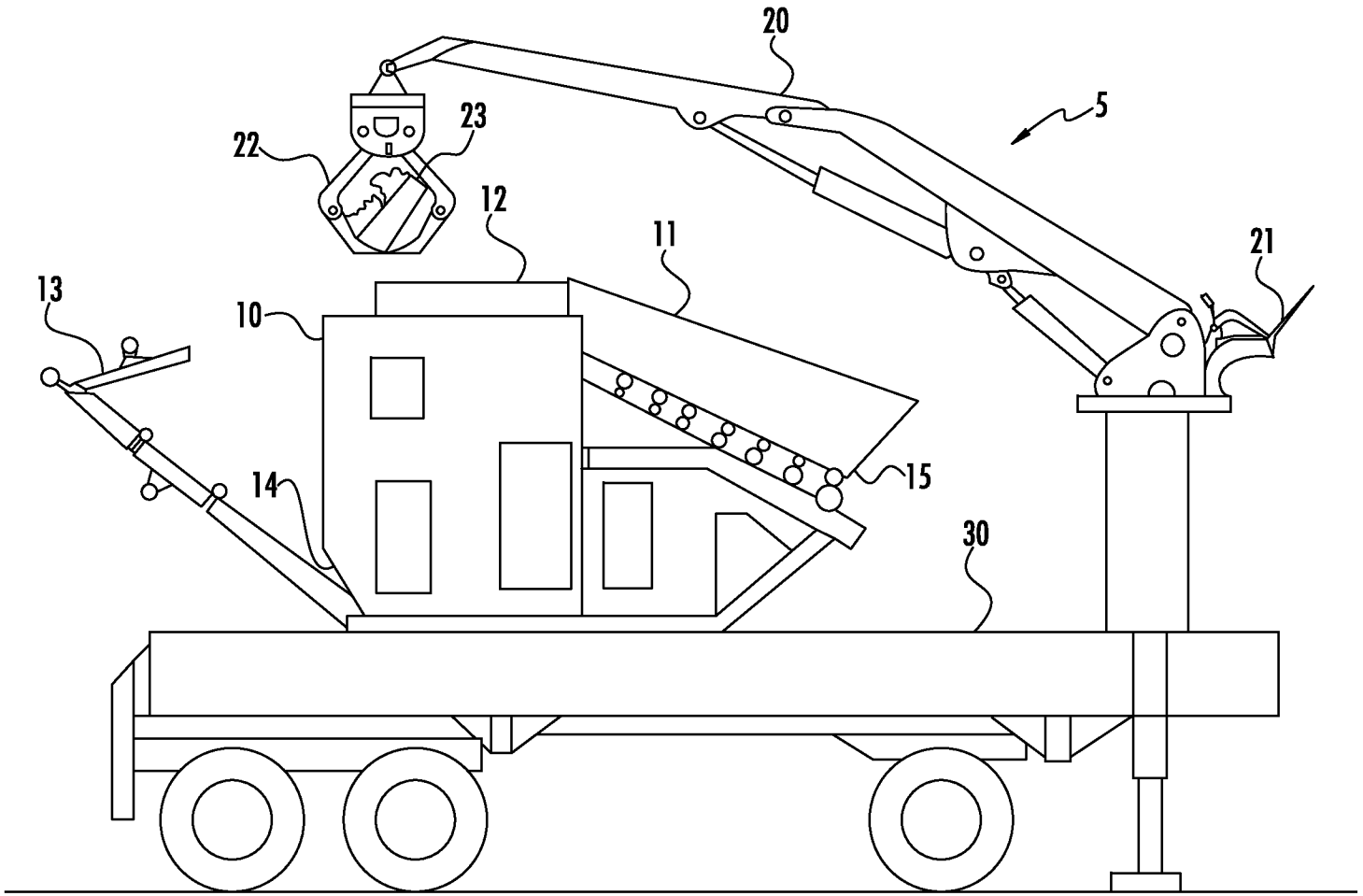
FIG. 1 is a side elevation view of a mobile self-contained loading and crushing apparatus according to one embodiment of the present invention, including a crusher unit and a loading device attached to a trailer capable of being connected to a transport vehicle.

The present invention provides apparatus and methodology for processing of waste concrete and other crushable solid waste materials, which enables production of crushed solid material from such waste, on-site or near-site to the source of the waste material. As a result, concrete waste that is inevitably present at construction sites as a result of pouring of concrete footers, foundations, patios, sidewalks, driveways, curbs and streets can be processed at the location that such waste is generated. The resulting crushed solid product material can then be recycled as particulate solids for makeup of fresh concrete, or such crushed solid product material can be used as a base material for foundations, sidewalks, driveways, streets, for graveled walkways and paths, or reinforcing fill for dry wells, sumps, drainage ditches, and the like.

In such manner, the substantial time, effort and expense associated with removal and transport to landfills of waste concrete and other solid waste construction/demolition debris is avoided, thereby achieving a compelling ecological and economic benefit by the use of the invention.

The present invention can be configured and arranged in a wide variety of specific implementations, for specific applications.

In one embodiment, the invention comprises a mobile loading and crusher system that includes a crusher unit having an inlet and outlet, a loading device capable of loading material into the inlet of the crusher unit, and a motive transport carrier (such as, for example, a truck, trailer, or the like) in which the crushing system is affixed to the motive transport carrier.

In another embodiment, the invention comprises a mobile, self-loading crusher apparatus that includes a crusher unit having an inlet and outlet, a loading device capable of loading material into the inlet of the crusher unit, and a trailer or flat-bed truck, wherein the crusher unit and loading device are affixed to the deck of the trailer or flat-bed truck and the resulting assembly is capable of being transported to a desired location.

In another embodiment, the waste solid crusher assembly of the invention includes a mobile crusher apparatus, wherein a crusher unit comprises one of a jaw, rotary, blade, impact crusher, or similar type of known crusher, or combination of such crushers.

In a further embodiment, the mobile crusher apparatus of the invention includes a crusher unit capable of producing an output of variable sized aggregate, e.g., in a range of size from 5 inches in diameter to 1 inch in diameter (the term "diameter" as used herein referring to a major length dimension when the particle or piece resulting from the crushing operation is non-spherical in character).

A further embodiment of the invention comprises a mobile crusher apparatus including a crusher unit with a screening device, wherein the screening device is utilized prior or subsequent to crushing, for separating out a predetermined sized material. For example, the screening device may be used prior to crushing, to separate out material that is generally smaller than the bulk of the waste material to be crushed. Alternatively, the screening device may be used after crushing, to separate or fractionate the crushed material, so that different-sized product materials are isolated for subsequent use.

In this respect, the invention of a further embodiment may comprise a mobile crusher apparatus including a crusher unit that provides an additional outlet to remove a predetermined sized material prior to crushing.

The invention in a still further embodiment comprises a mobile crusher apparatus including a crusher unit that provides at least one outlet conveyor for directing an outlet stream from the crusher unit. In another embodiment, the outlet is a two-conveyor dispense arrangement with a diverter blade between the outlet directed to each conveyor, so that crushed concrete can be dispensed to a longitudinal conveyor or to a transversely extending conveyor, or to both with the blade at an approximately 45° angle relative to the outlet opening.

The mobile crusher apparatus may in a further embodiment comprise a crusher unit that includes an internal power source and/or magnetic device for removal of iron objects from the crushed material.

In another variant embodiment of the invention, the mobile crushing and loading system is capable of being operated in a single location by one person.

The mobile crusher apparatus may be configured with a motive carrier structure that includes a trailer or truck with a deck having a first end and a second end, wherein the crusher unit is affixed to the trailer at the second end and the loading device is affixed to the first end.

In other embodiments of the mobile crusher apparatus, a loading device may be provided that comprises one of a crane, hoist, knuckleboom loader, or other type of loading device having an arm or mechanism capable of lifting material for loading into the crusher unit.

For example, the mobile crusher apparatus may include a loading device that is capable of lifting we weight equivalent to the specifications of a Rotobec™ Elite XT to an inlet of the crusher unit. In addition, the loading arm may include an extendable arm so that the system has the reach necessary to pull material from a greater distance and to keep from having to move the truck/trailer each time material is needed to be loaded. The extended arm allows for a further reaching capacity, which in turn also allows for a quicker job turn around, which therefore improves the overall system performance by keeping the truck/trailer stationary during the job.

In one particular embodiment, a grapple is chosen for the ability to pick up large and small concrete and masonry products, selectively sort debris for crushing, move and distribute crushed product, and use its powerful jaws to break large concrete slabs for feed prep into the crusher.

In another configuration, the mobile crusher apparatus may be constructed with a loading device that includes a handler assembly comprising one of a clamshell, bucket, scoop, jaw, claw or any other type of handler assembly capable of grasping or gathering material for lifting and loading into the crusher unit.

A still further aspect of the invention relates to a method of on-site or near-site recycling of concrete, construction, or similar type crushable waste (feed material). In one illustrative embodiment, a loading device affixed to a mobile apparatus is operated to load the crushable waste into an inlet of a crusher unit affixed to the mobile apparatus. The crushable ways than is processed by crushing in the crusher unit to form a crushed product material. The crushed product material can then be discharged from the crusher unit of the apparatus, e.g., in an output stream in which the particles are pieces of crushed material are of a uniform size, or are similarly sized, such as in a range from five inches in diameter to one inch in diameter.

The loading and crushing apparatus and method of the present invention provide a large volume crusher unit and a loading device attached to a mobile carrier structure, e.g., a motive vehicular structure such as a truck, trailer, or the like. The invention in a specific embodiment comprises a self-contained loading and crushing system that includes a large volume crusher unit, a loading device and an operating station attached to the mobile carrier structure. The advantages of the present invention include, but are not limited to: eliminating the need for and costs associated with additional equipment for loading the crusher or, alternatively, vehicles to transport un-crushed material to a processing plant or landfill; facilitating the ease of transport by the provision of only one mobile apparatus providing single duty capability for collection, crushing processing, and discharge of processed crushed waste solids material; providing a self-contained apparatus that is capable of travel on existing roadways, including secondary and tertiary roads; integrating an operating system that allows one operator to simultaneously control the loading device and crusher unit; providing a high capacity crushing apparatus that can be operated while attached to a transport vehicle; and reducing pollution that would otherwise be involved in the transport of material to landfills or other waste solids processing facilities.

The terms "crusher unit," "crusher apparatus," or "crushing apparatus" as used herein include any type of crusher capable of being affixed to a mobile carrier structure, such as for example a truck, trailer or the like. The resulting apparatus including collection and crushing capability with a mobile carrier structure is preferably configured as a flat-bed truck assembly with size and weight characteristics that permit the assembly to travel on highways as well as secondary and tertiary roadways, so that the assembly can navigate the streets of subdivisions and commercial districts and carry out processing of crushable waste solid material, such as concrete, crushable building materials, and the like.

In various specific embodiments, the crusher unit can be configured so that it has a height up to 13.5 feet to allow passage under many overpasses and bridges without the need to disassemble the unit. The crusher unit itself may include any type of crusher, including but not limited to rotary, impact, jaw crushers, and the like, that is capable of producing an output of reduced-size material. The crusher unit may include crushers capable of producing a variable output of crushed material in a range of sizes, e.g., crushed material with an average diameter as large as five inches to as small as one inch. The crusher unit may include crushers with a hopper and/or an inlet conveyor and may also include crushers with a screening device for removing a predetermined sized particulate material (smaller than the material to be crushed) from the material to be crushed. The crusher unit may also include crushers with a conveyor or other such means for removing a predetermined sized material after it has been separated from the raw material to be crushed, and crushers can be employed that include a magnetic device for removing iron particles or pieces from the crushed material. Crusher units may also be employed with a screening device positioned after the crusher to separate the output stream into various sizes, and the crusher unit may be equipped with an outlet conveyor for transporting the outlet stream to the ground or to another vehicle or collection structure. Crusher units may also be employed that include crushers that can be powered by their own power plant, or powered by a transport vehicle, e.g., by a power take-off coupling arrangement, or powered by a remote power source.

The term "loading device" as used herein refers to any type of loading device capable of being affixed to a mobile carrier structure, such as a truck, trailer or the like, and capable of lifting construction or waste material to the inlet of a crusher unit. The loading device includes any suitable apparatus that is capable of gathering, grasping, loading or collecting rocks, pieces of concrete, solid crushable construction waste and the like, e.g., concrete slab waste as large as three to four feet in length. The loading device may include any type of arm or boom loader, knuckleboom loaders, hoists, articulated arm loaders, and may include any type of handler assembly such as a clamshell, bucket, scoop, and claw assemblies, and the like to pick up and lift rocks, pieces of concrete, solid crushable construction waste and the like.

The term "feed material" as used herein refers to any rock, concrete, construction waste, masonry waste or similar hard material, that is crushable in character. Such material may be generated or recovered from such activities such as construction and demolition of roads, buildings, or other natural or artificial structures or installations.

The apparatus of the invention may be constructed by affixing the crusher unit and loading device to the deck of a truck/trailer by means known to those of skill in the art. The term "affixing" as used herein includes secure attachment to the trailer sufficient to safely maintain attachment during transport and use. The secure attachment may include bolting, welding, and/or other means of secure fastening. Affixing also includes attaching the machines to a frame and affixing the frame to a trailer deck or truck bed/frame, or attaching the crusher unit and loading device directly to the deck of the trailer or truck bed/frame. Affixing also includes attaching the crusher unit and the loading device or any frame structure to which such machines are attached directly to the chassis of a truck/trailer in combination with attachment to the deck of the truck/trailer. Affixing also includes attaching the machines through the deck of the truck/trailer to the chassis of the truck/trailer. One particular aspect of the present invention is the critical dimension relationship of the particular wheel base distances between one another to accommodate the load of the equipment (including the crusher unit, loading device, conveyors and operating station) on the truck/trailer bed. In a specific embodiment, the center of gravity is located on the back of a truck bed, e.g., at an intermediate distance location that defines a lengthwise distance as measured from the leading edge of the motive carrier trailer that is from 40% to 60% of the length of the motive carrier. In another specific embodiment, the truck comprises a front pair of wheels and four pairs of rear wheels spaced at intervals to accommodate the weight on many public roadways, the center of the first rear wheel being approximately 11 feet behind the center of the first, the second two rear wheels being a tandem wheel system, the first wheel being approximately 7 feet, 8⅓ inch behind the first rear wheel, the second being approximately 4 feet, 1¾ inch behind the first tandem rear wheel. The last wheel is approximately 5 feet behind the second tandem wheel. More generally, exemplary wheel spacing may be from the first pair to the second 8-15 feet, from the second to the third 4-13 feet, from the third to the fourth 2.5-6, and from the fourth to the fifth 3-9 feet. A lesser number of wheel pairs may be possible so long as a wheel pair axle is located approximate to the center of gravity, and more preferably one pair of a tandem wheel system. This specific system provides sufficient support on most public roadways, and on many private roads.

The invention resolves a fundamental problem in the construction and demolition industries in a simple but unexpected and non-obvious manner. The conventional wisdom in these industries is that concrete waste after being produced at a construction or demolition site is most advantageously transported to a landfill or dedicated fixed-location crushing installation. The present invention integrates crushing and loading/dispensing capability in a unitary motive vehicular assembly that is readily transportable to a job site, comporting with roadway weight limits (e.g., being less than 80,000 pounds in weight, preferably less than 60,000 pounds, and most preferably less than 50,000 pounds) in a weight-balanced configuration that is surprisingly efficient.

In one embodiment, the vehicular assembly is constituted by a truck-trailer assembly that includes an operator station with a pivotable and swingable boom-type collector, of an omni-directional character that is operable to deliver large chunk-size concrete waste to the intake of a crusher unit mounted on a trailer bed, with the crusher having a discharge capability for delivery of crushed waste material to a localized ground area or collection device, with the crusher unit having a center of gravity that is vertically aligned with an axle of the trailer of the vehicular assembly.

The advantages and features of the invention described above are further illustrated with reference to the drawings, which are not to be construed as in any way limiting the scope of the invention, but rather as illustrative of specific embodiments of the invention in particular applications thereof. For example, the loading device of the invention is illustratively depicted in the drawings as a hinged boom or arm with a claw type handler assembly. This type of loader is known as a knuckleboom loader, but this depiction is not meant to limit the loading device of the invention, and the loading device of the invention can be any loading device that is for example mountable on a trailer and capable of lifting rocks, pieces of concrete, construction waste and the like (feed material) to the height of the inlet of the crusher unit.

Referring now to the drawings, FIG. 1 depicts a side view of a mobile self-contained crusher apparatus 5 in accordance with one embodiment of the present invention. The mobile self-contained crusher apparatus 5 includes a crusher unit 10 and a loading device 20 attached or affixed by affixing means to the deck of a trailer 30, which includes a hitch (not shown) that allows the trailer be towed by a transport vehicle. By affixing the loading device 20 and crusher unit 10 to the deck of trailer 30, the mobile self-contained crusher apparatus 5 is a self-sufficient unit that requires no other vehicles for loading and only requires a single tow vehicle for transporting to and from the site. The crusher apparatus 5 includes the loading device 20 for self-loading the crusher unit 10, thus eliminating the need for a backhoe, excavator, crane, front-loader, or other type of tracked or wheeled construction equipment capable of gathering, lifting, and raising the heavy rocks, pieces of concrete, construction waste and the like into an inlet 12 as necessary to load the crusher unit 10.

In the embodiment depicted in FIG. 1, the crusher unit 10 includes an inlet 12 for intake of the material for crushing and an outlet 14 for output of the crushed aggregate. The crusher unit 10 also optionally includes a hopper 11 for receiving larger amounts of material to be crushed and an outlet conveyor 13 for transporting the crushed material to the roadway surface or for delivery of the output stream to another vehicle or location. FIG. 1 also depicts a side view of the loading device 20 with the boom arm extended to position a claw handler 22 over the inlet 12 in order to load concrete pieces 23 into the crusher unit 10.

Figure 2:
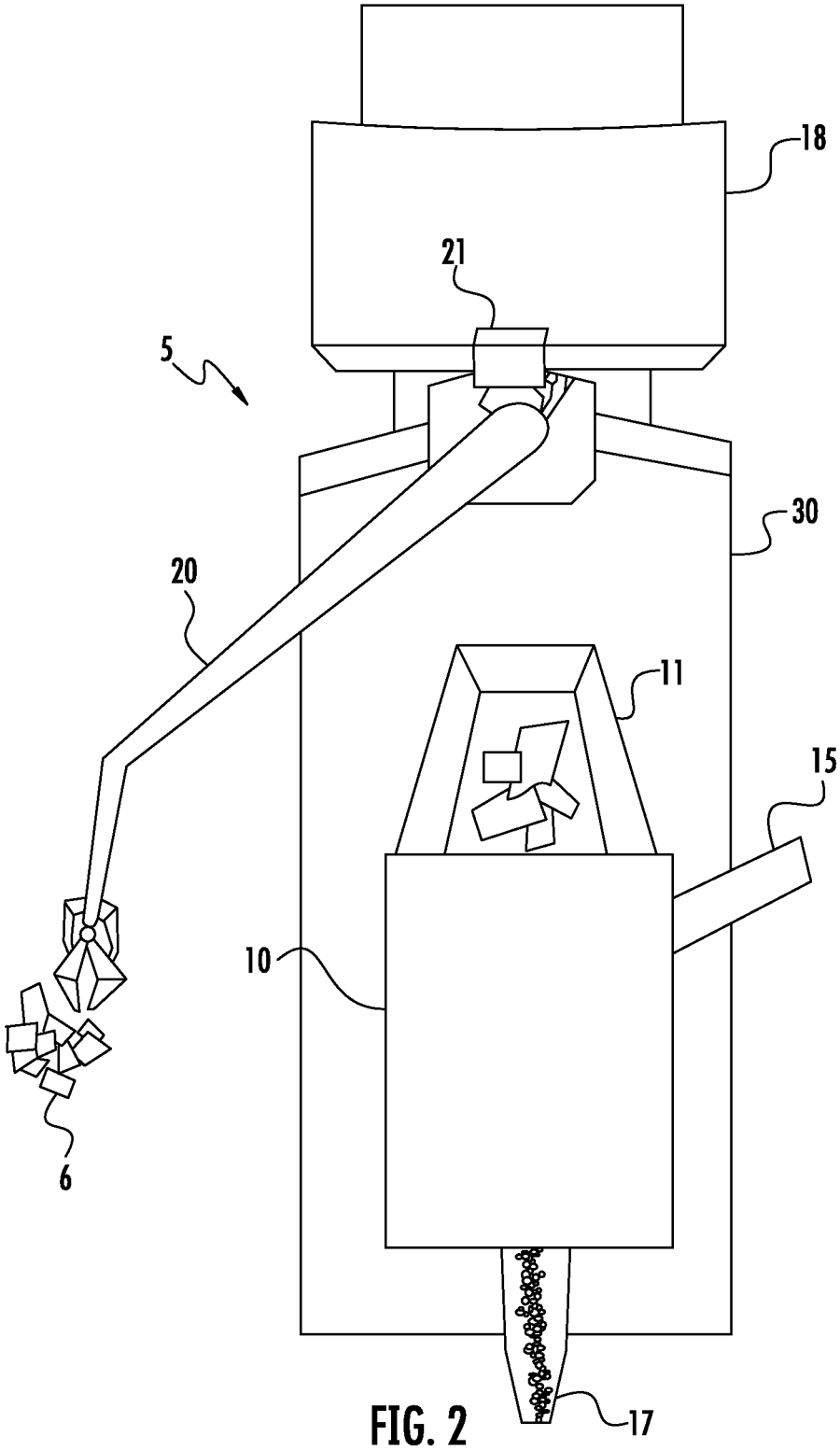
FIG. 2 is a top view of one embodiment of a mobile self-contained loading and crushing apparatus of the present invention, depicting the loading device in operation ready to lift a pile of road paving debris to the inlet of the crusher unit.
Figure 3:
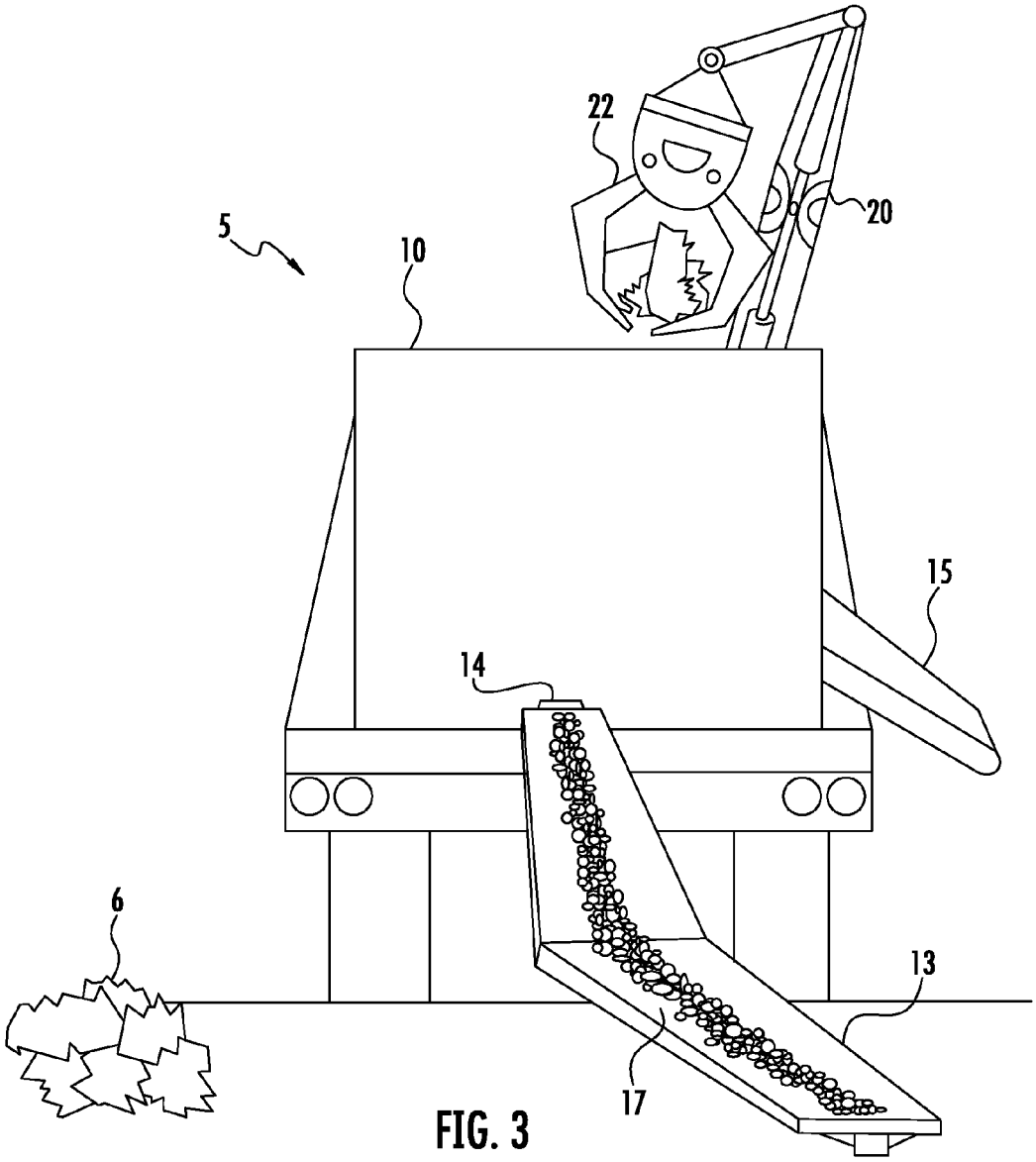
FIG. 3 is a rear elevation view of one embodiment of a mobile self-contained loading and crushing apparatus of the present invention, depicting the apparatus in operation, with crushed material exiting the outlet of the crusher unit while the loading device is loading the inlet of the crusher with crushable solid feed material.

Referring now to FIG. 2 and FIG. 3, which depict a top view and a rear view, respectively, of the mobile self-contained crusher apparatus 5 in operation. The loading device 20 is depicted in FIG. 2 with the articulated boom bent slightly extending to the ground to grasp concrete and construction debris 6. FIG. 2 depicts an embodiment of the crusher apparatus 5 with the loading device 20 positioned at the front end of the trailer 30, in between a transport vehicle 18 and the crusher unit 10. By positioning the loading device 20 and crusher unit 10 in this configuration, an output stream of aggregate 17 can be deposited directly onto the roadway if desired for use as a road surface. Alternatively, as depicted in FIG. 3, the output stream of crushed material 17 from the outlet 14 can be directed using the optional outlet conveyor 13 to the side of the roadway or to another vehicle (not shown).

Also depicted in FIG. 2 and FIG. 3 are several optional features of the crusher unit 10 and crusher apparatus 5. For example, a side outlet 15 may be included for removing a portion of predetermined sized material from the material to be crushed. The side outlet 15 may also include an outlet conveyor and hopper for depositing pieces of concrete material and may be operatively connected by conveyor to the inlet 12 (FIG. 1) of the crusher unit 10. Also, as shown in FIG. 2, the controls and operator's station 21 for the loading device 20. The crusher apparatus 5 is capable of being controlled by one operator from the operating station 21, who can load the crusher unit 10 with the loading device 20 from the operating station 21, and also operate the crusher unit 10 (possibly via remote control) from operating station 21. By combining the loading and crushing capability at the control of one person, crusher apparatus 5 further increases the economic benefits associated with using the apparatus, reducing the manpower and equipment resources necessary to recycle the rock, concrete, construction waste and the like.

Figure 4:
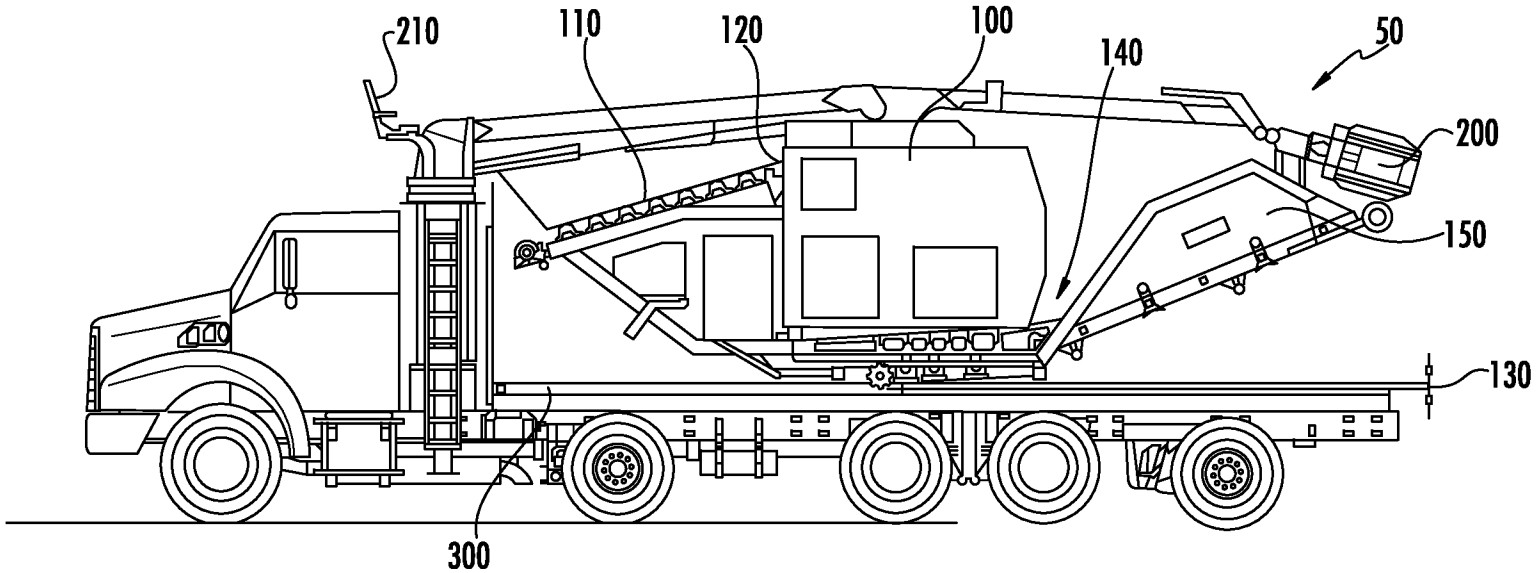
FIG. 4 is a side view of one embodiment of a mobile loading and crushing system of the present invention, depicting a crusher unit, a loading device with an operating station, and conveyor systems for delivery of feed material and removal of processed material.

FIG. 4 is an angled side view of one embodiment of a mobile loading and crushing system 50 of the present invention, depicting a crusher unit 100, a loading device 200 and an operating station 210 attached to the bed 300 of a truck, in which the operating station 210 is configured to operate both the crusher unit and loading device simultaneously. Unique to this embodiment is the dual outlet conveyor option leading from the outlet 140. In particular, a diverter (FIG. 5) can send the processed material out the rear of the truck on a rear conveyor 130 and/or send the processed material out a folding side conveyor 150 that may include a swing joint to swivel the folding conveyor 150 from the back to one or more sides of the truck bed 300. In a particular embodiment, the folding side conveyor 150 could extend 16 feet, where folded in half it would only extend 8 feet and therefore be easy to transport when repositioned over the back of the truck bed 300. Additionally, the rear conveyor 130 may include an extension off the back of the trick bed 300 to provide a greater travel distance of the processed material from the back of the truck to avoid a collection of material at the immediate rear of the truck. The operating station 210 would ideally control the entire system. Note that in this embodiment of FIG. 4, the center of gravity is approximately over the first rear tandem wheel. Moreover, the crusher unit 100 also optionally includes a hopper or inlet conveyor 110 for receiving larger amounts of material to be crushed.

Figure 5:
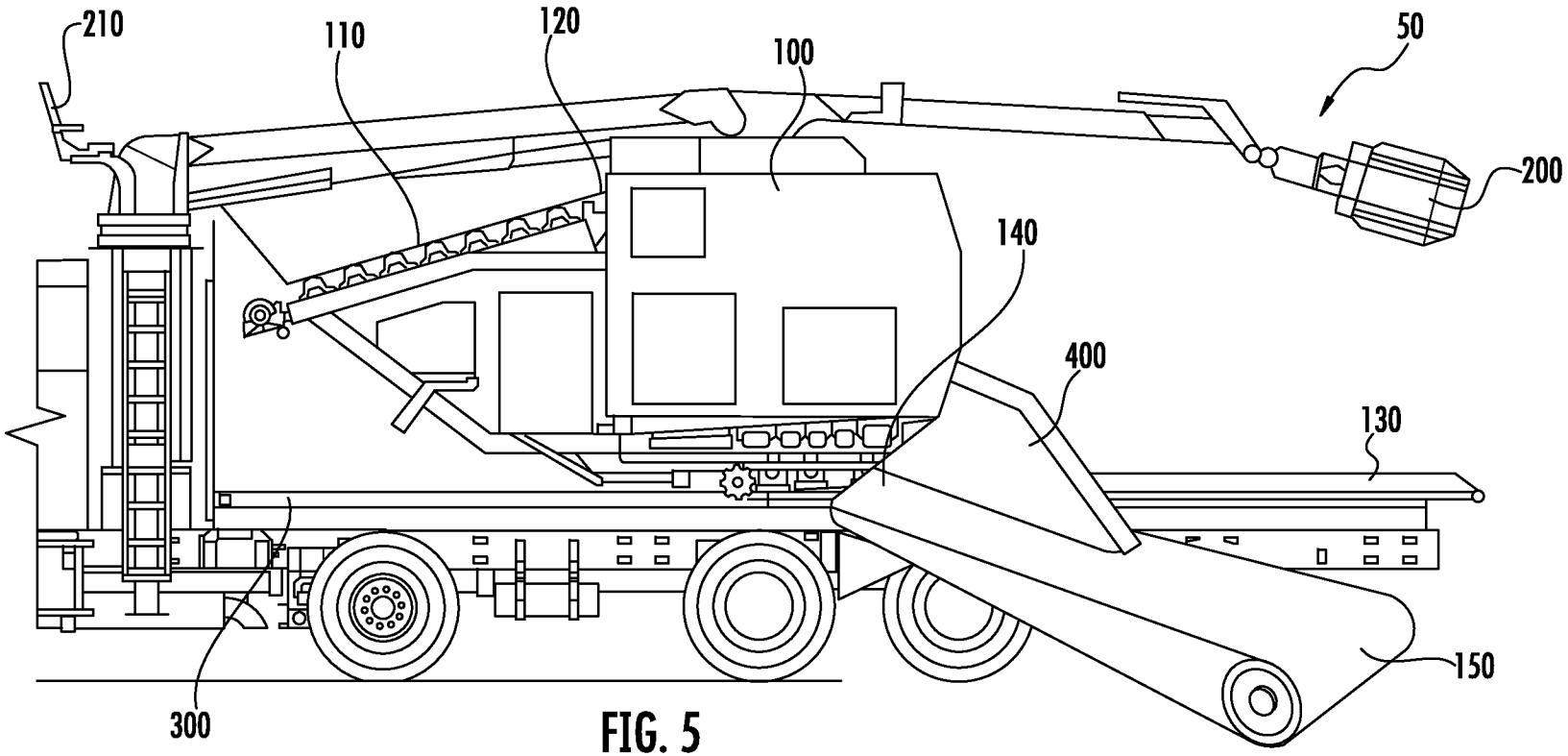
FIG. 5 is a side view of one embodiment of a mobile loading and crushing system of the present invention, depicting a crusher unit, a loading device with an operating station, and conveyor systems with diverter for optional removal of processed material into one of two conveyor outlets.

FIG. 5 shows the diverter 400 that separates or divides the flow of processed material between the rear conveyor 130 and the side conveyor 150.

Figure 6:
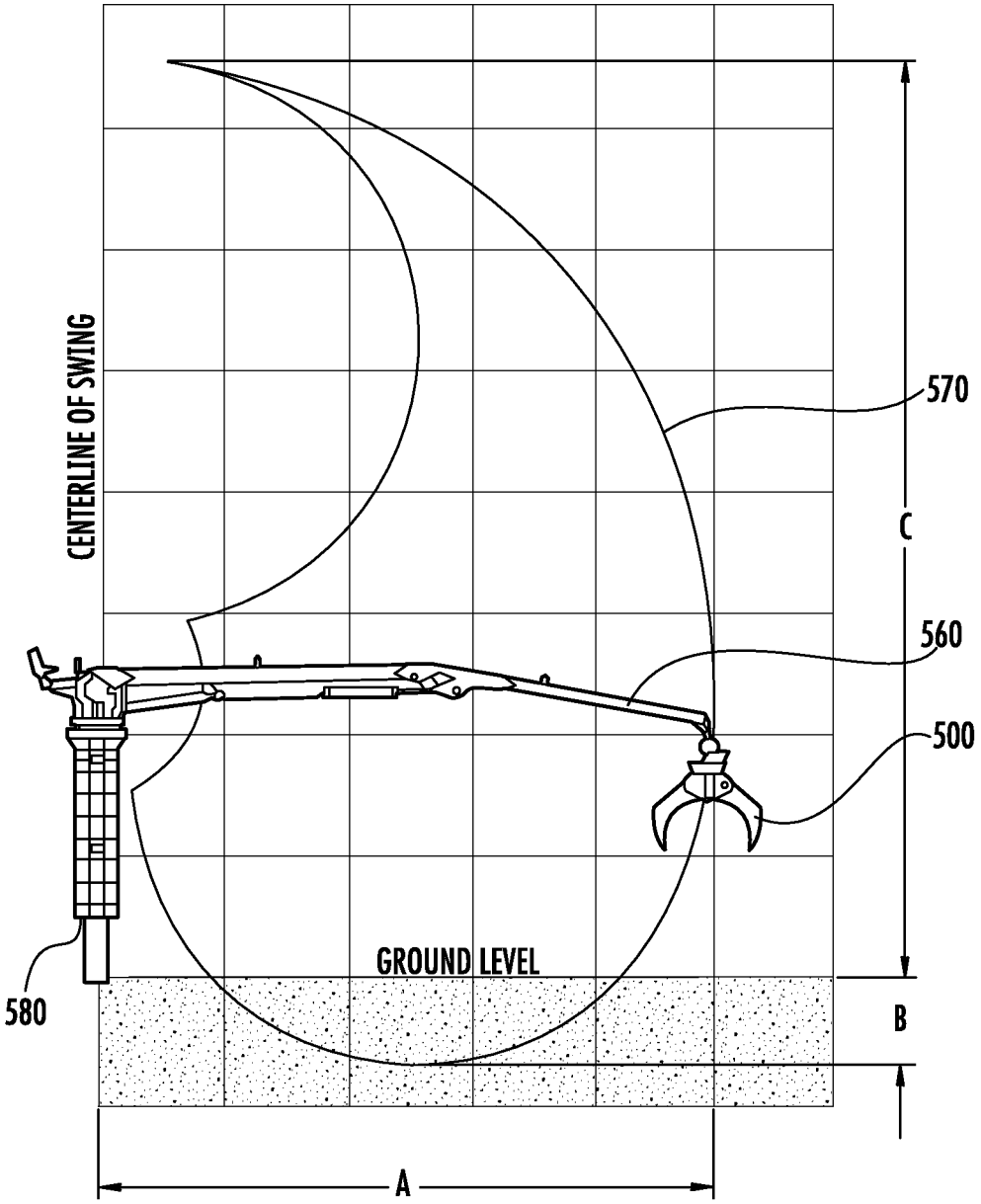
FIG. 6 is a schematic side view of a loading apparatus with extension in an embodiment of the present invention.

FIG. 6 reveals a side view of a loading apparatus with an extension arm 560 that extends the length and reach of the loading apparatus to allow for at least 4 feet of greater reach from the base 580 of the loader so that the mobile apparatus need not be moved while the grabber 500 can extend to a greater radius 570. A preferred loader for this embodiment would be the Robotec™ Elite Boom Arm with arm extension.

Figure 7:
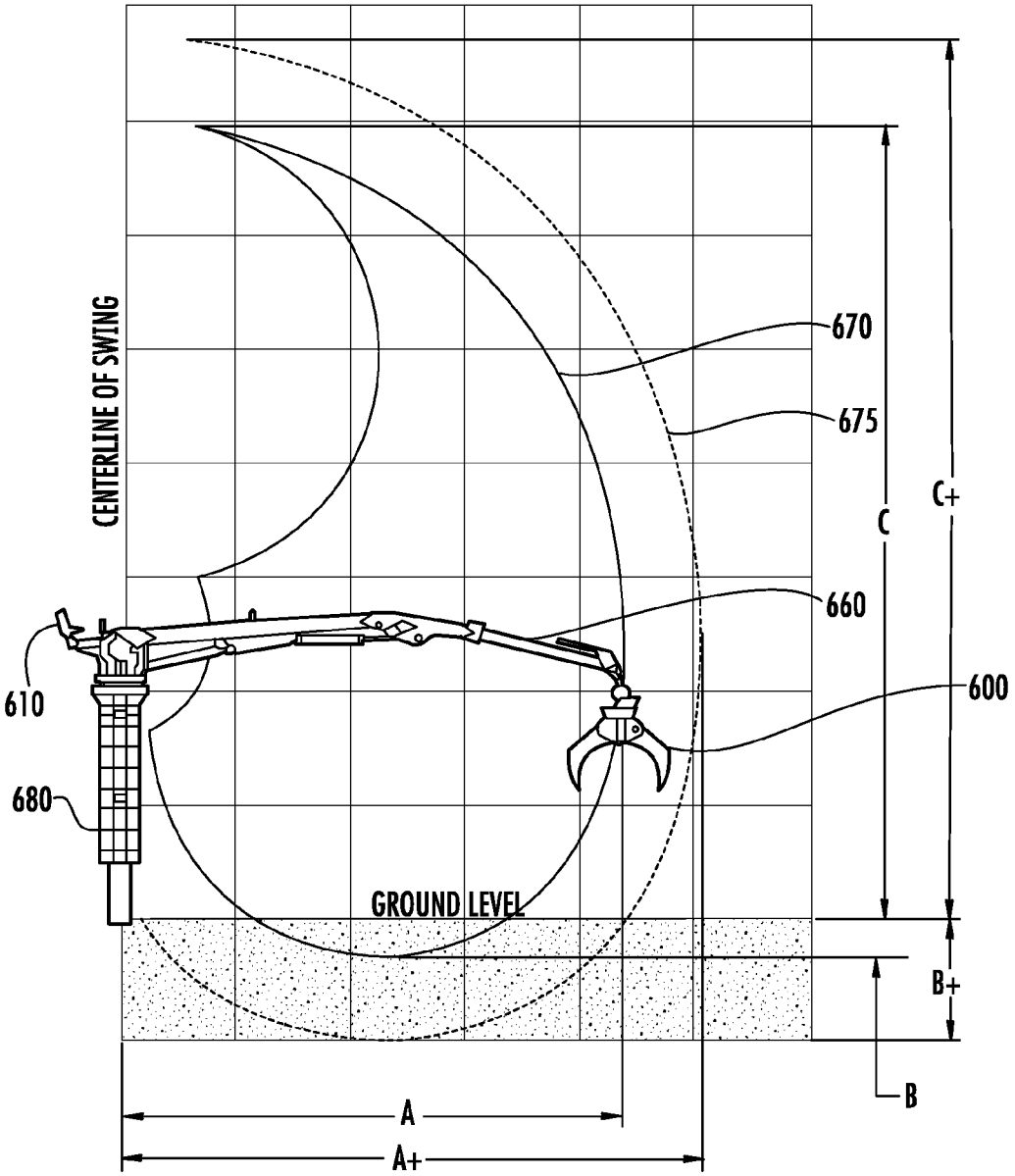
FIG. 7 is a schematic side view of a loading apparatus without extension in an embodiment of the present invention.

FIG. 7 reveals a side view of a loading apparatus without an extension arm 660 such that the radius 670 from the base 680 can not be modified to the expanded radius 675 that would otherwise be available with an extension arm. Therefore, the grabber 600 has less of an expanded reach than would otherwise be available with the added extension represented in the dotted line 675, having a greater expansion of distance A+.

Figure 8B:
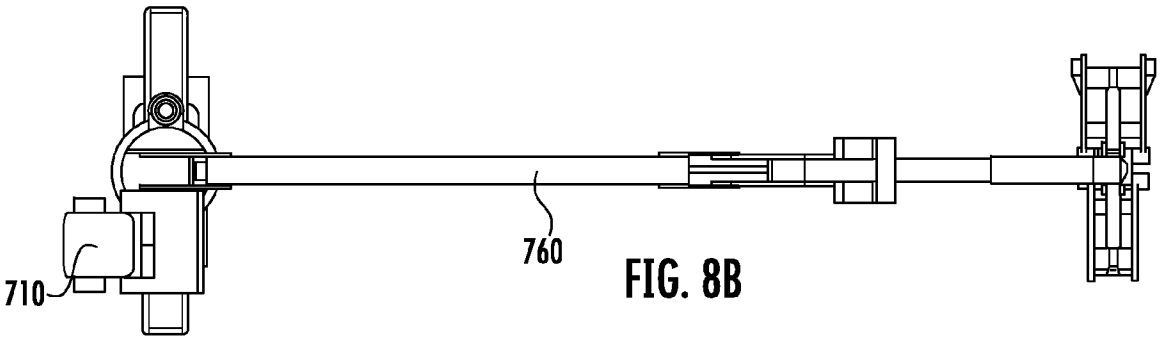
FIGS. 8A-8D are various schematic aspects of a loading apparatus of one embodiment of the present invention.
Figure 8D:
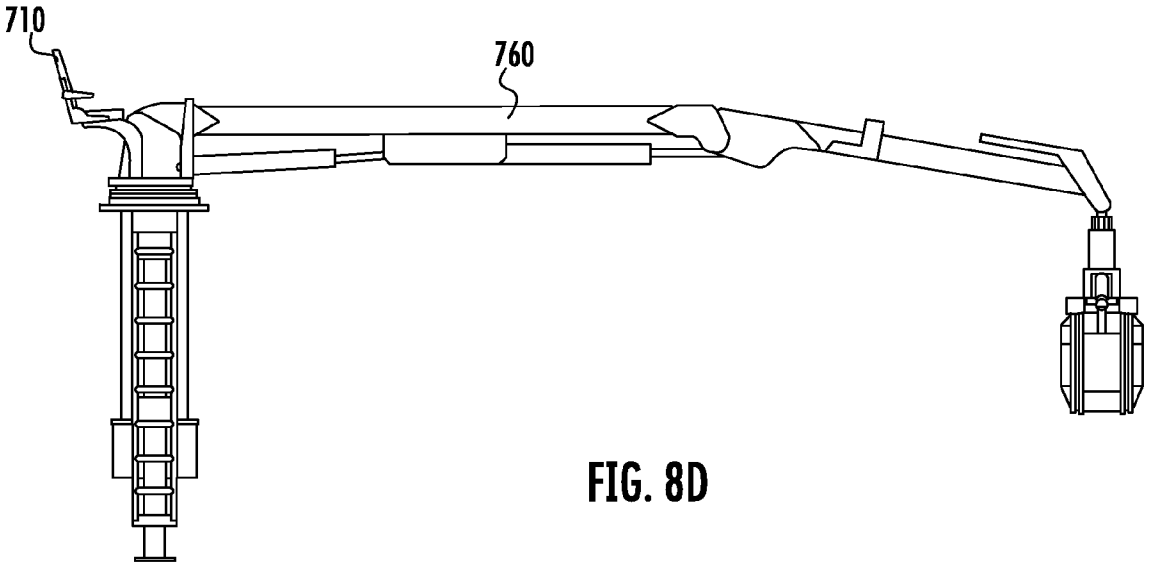
Figure 8A:
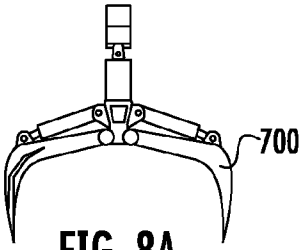
Figure 8C:
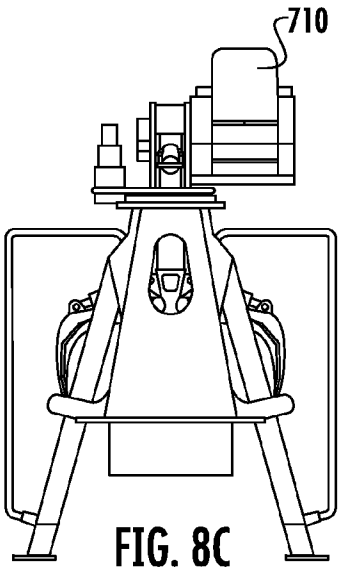

FIG. 8A reveals a particular grabber 700 with dual hydraulically powered clinching arms. FIG. 8B is a top-down view of a loading apparatus with the operating station 710. The loading arm 760 supports and maneuvers the grabber 700 as controlled by a user in the operating station 710. FIG. 8C is a rear view of the loading apparatus of FIG. 8B, and likewise FIG. 8D is a side view. Acceptable dimensions are provided in FIGS. 8A-8D based on a preferred loader for this embodiment in a Rotobec™ Elite XT. For instance, a Rotobec™ Elite XT MT27 would have an unextended length reach of 284 inches (A), and an extended length reach of 326 inches (A+), an unextended height reach of 437 inches (C), and extended height reach of 479 inches (C+), and an unextended depth reach of 23 inches (B), and an extended depth reach of 65 inches (B+).

Figure 9:
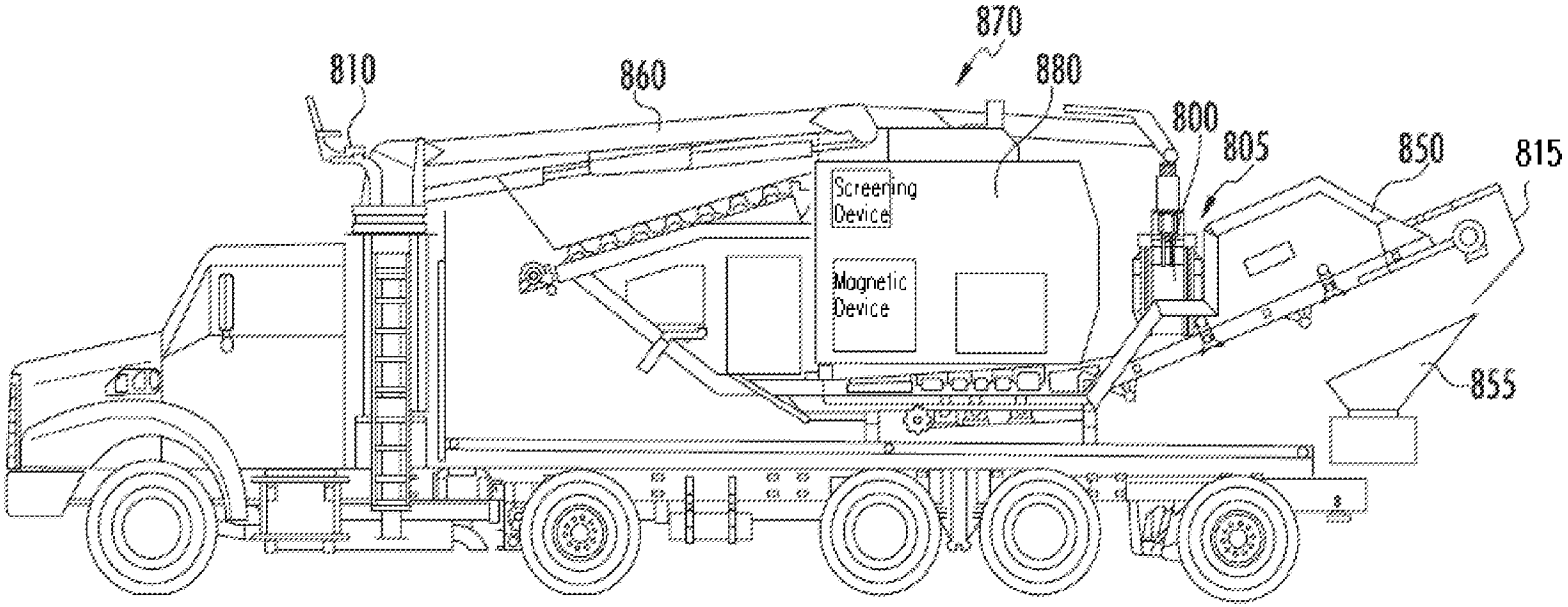
FIG. 9 is a side view of one embodiment of a mobile loading and crushing system of the present invention, depicting a crusher unit, a loading device with an operating station, conveyor systems for delivery of feed material and removal of processed material, and discharge bucket/shoot.

FIG. 9 is a side view of a mobile loading and crushing system 870 depicting a crusher 880, a loading device 860 with an operating station 810, conveyor systems 850 for delivery of feed material and removal of processed material along with a protective shield 815 that allows the crushed material to be directed into the discharge bucket/shoot/ramp 855 below, wherein the discharge bucket/shoot/ramp 855 that allows the material to be directed down a shoot upwards of 9 feet long in length allowing a user to direct the discharged material more accurately. A storage compartment 805 designed specifically for the grapple 800 attachment has been modified to allow the grapple 800 to be tucked neatly behind the crusher body 870 and on top of the shroud of the conveyor belt 850.

While the invention has been described herein with reference to specific aspects, features and illustrative embodiments of the invention, it will be appreciated that the utility of the invention is not so limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted as including all such variations, modifications and alternative embodiments within its spirit and scope.

What is claimed is:

1. A mobile loading and crushing apparatus, comprising:
- a mobile carrier;
- a crusher unit having an inlet and an outlet, wherein the crusher unit is affixed to the mobile carrier; and
- a loading device affixed to the mobile carrier, wherein the loading device is capable of loading the inlet of the crusher unit with feed material for crushing by the crusher unit by lifting the feed material to the inlet of the crusher unit, wherein the crusher unit includes a second outlet to remove predetermined size pieces of material, and wherein an adjustable diverter is provided to control a first volume of material to the outlet and a second volume of material to the second outlet.

2. The apparatus of claim 1, wherein the apparatus further includes an operating station for controlling the crusher unit and the loading device.

3. The apparatus of claim 2, wherein the apparatus is configured to be operated by a single operator.

4. The apparatus of claim 1, wherein the crusher unit further comprises one of a jaw crusher, a rotary crusher, or an impact crusher, capable of processing the feed material.

5. The apparatus of claim 4, wherein the crusher unit is configured to produce an output of crushed material comprising pieces having size within a range from about 1 inch in diameter to about 5 inches in diameter.

6. The apparatus of claim 4, wherein the crusher unit includes a magnetic device for removal of iron-containing material from the feed material or crushed material generated in operation of the crusher unit.

7. The apparatus of claim 4, wherein the loading device further comprises one of a crane, a hoist, a knuckleboom loader, or a loading device having an arm capable of lifting the feed material.

8. The apparatus of claim 7, wherein the loading device includes a handler assembly.

9. The apparatus of claim 8, wherein the handler assembly comprises one of a clamshell, bucket, scoop, jaw, claw or a handler assembly capable of collecting the feed material for lifting.

10. The apparatus of claim 8, wherein the handler assembly comprises a bucket or scoop that lacks internal structure.

11. The apparatus of claim 1, wherein the crusher unit includes a screening device for separating out predetermined size pieces of material prior from the feed material.

12. The apparatus of claim 1, wherein the crusher unit includes an outlet conveyor for discharging crushed material from the crusher unit.

13. The apparatus of claim 1, wherein the crusher unit includes an internal power source.

14. The apparatus of claim 1, wherein the mobile carrier comprises a trailer, a deck on the trailer, a first end of the deck, and a second end of the deck.

15. The apparatus of claim 14, wherein the crusher unit is affixed to the trailer at the second end of the deck of the trailer and the loading device is affixed to the first end of the deck of the trailer.

16. The apparatus of claim 1, wherein the loading device further comprises a protective shield for directing crushed material into a bucket shoot.

17. The apparatus of claim 1, further comprising a storage compartment adapted for storing at least a portion of the handler assembly.

18. The apparatus of claim 1, wherein a wheel displacement of the mobile carrier comprises:
- a first wheel;
- a center of a second wheel approximately 11 feet behind a center of the first wheel;
- a center of a third wheel approximately 7 feet, 8⅓ inch behind the center of the second wheel;
- a center of a fourth wheel approximately 4 feet, 1¾ inch behind the center of the third wheel;
- a center of a fifth wheel approximately 5 feet behind the center of the fourth wheel; and
- wherein the third and fourth wheels are a tandem wheel system.

19. A mobile system for processing solid crushable feed material, comprising:
- a mobile carrier;
- a crusher unit having an inlet and an outlet, wherein the crusher unit is affixed to the mobile carrier;
- a loading device affixed to the mobile carrier, wherein the loading device is capable of loading the inlet of the crusher unit with feed material for crushing by the crusher unit by lifting the feed material to the inlet of the crusher unit, wherein the crusher unit includes a second outlet to remove predetermined size pieces of material, and wherein an adjustable diverter is provided to control a first volume of material to the outlet and a second volume of material to the second outlet; and an operating station for operating the crusher unit and the loading device.

20. The mobile system of claim 19, wherein the operating station is configured for simultaneous operation of the crusher unit and the loading device.

* * * * *